US008620181B2

(12) United States Patent
Murakami

(10) Patent No.: US 8,620,181 B2
(45) Date of Patent: Dec. 31, 2013

(54) PROCESS CARTRIDGE AND ELECTROPHOTOGRAPHIC IMAGE FORMING APPARATUS

(75) Inventor: Ryuta Murakami, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 13/108,351

(22) Filed: May 16, 2011

(65) Prior Publication Data

US 2011/0286765 A1 Nov. 24, 2011

(30) Foreign Application Priority Data

May 19, 2010 (JP) ..... 2010-115377
Apr. 20, 2011 (JP) ..... 2011-094121

(51) Int. Cl.
*G03G 21/18* (2006.01)

(52) U.S. Cl.
USPC ..... 399/114

(58) Field of Classification Search
USPC ..... 399/111, 114
See application file for complete search history.

(56) References Cited

U.S. PATENT DOCUMENTS 5,266,999 A * 11/1993 Yashiro ..... 399/114
6,078,764 A * 6/2000 Akutsu ..... 399/114
6,236,822 B1 * 5/2001 Kawaguchi ..... 399/114
6,661,977 B1 * 12/2003 Kubota ..... 399/114 X
6,735,405 B2 5/2004 Yokoi et al.
6,836,639 B2 12/2004 Karakama et al.
6,898,392 B2 5/2005 Karakama et al.
6,968,142 B2 * 11/2005 Arimitsu et al. ..... 399/114
6,987,938 B2 1/2006 Murakami et al.
7,024,131 B2 4/2006 Komatsu et al.
7,156,797 B2 1/2007 Komatsu et al.
7,206,534 B2 4/2007 Murakami
2009/0297219 A1 * 12/2009 Yoshino et al. ..... 399/114

FOREIGN PATENT DOCUMENTS

JP 5-297646 11/1993

* cited by examiner

*Primary Examiner* — Sandra Brase
(74) *Attorney, Agent, or Firm* — Fitzpatrick, Cella, Harper & Scinto

(57) ABSTRACT

A process cartridge is detachably mountable to a main assembly of an electrophotographic image forming apparatus. The process cartridge includes an electrophotographic photosensitive member; a first frame for supporting the photosensitive member; a developer carrying member for developing an electrostatic latent image formed on the photosensitive member; an opening, provided in the first frame, through which the photosensitive member is exposed; a shutter, provided on the first frame, movable between an open position in which the opening is uncovered and a closed position in which the opening is covered; and a spacer member movably provided on the shutter. When the shutter is located at the closed position, the spacer member is movable to a spacing position in which the spacer member is between the photosensitive member and the developer carrying member to provide a spacing between the photosensitive member and the developer carrying member, and a retracted position in which the opening is covered with the spacer member.

21 Claims, 17 Drawing Sheets

(a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus.

The process cartridge detachably mountable to an apparatus main assembly of the electrophotographic image forming apparatus has been known. The process cartridge is provided with a developer carrying member acting on an electrophotographic photosensitive member, and a frame of the process cartridge is provided with an opening for permitting contact between the electrophotographic photosensitive member and a transfer member during image formation.

In such a process cartridge, during packing and transportation, a spacer member for spacing the electrophotographic photosensitive member and the developer carrying member in order to prevent damage of these members due to contact between these members has been known. Further, in order to prevent dust or the like from being deposited on the surface of the electrophotographic photosensitive member, a shutter for covering the above-described opening in a state in which the contact is removed and for opening (uncovering) the opening in a state in which the process cartridge is mounted has also been known.

Incidentally, Japanese Laid-Open Patent Application No. Hei 05-297646 has disclosed a constitution in which a film member for protecting the electrophotographic photosensitive member and the developer carrying member from vibration and impact by being interposed therebetween during the packing and transporting of the process cartridge is applied to an end of the shutter. According to this constitution, when the process cartridge is mounted in the apparatus main assembly of the image forming apparatus, in interrelation with a shutter opening operation, the film member can be pulled out from between the electrophotographic photosensitive member and the developer carrying member.

SUMMARY OF THE INVENTION

The present invention provides a further development of the above-described conventional constitution.

A principal object of the present invention is to provide a process cartridge, including a spacer member for spacing an electrophotographic photosensitive member and a developer carrying member, capable of protecting the electrophotographic photosensitive member by the spacer member released from a spaced state between the electrophotographic photosensitive member and the developer carrying member.

Another object of the present invention is to provide an electrophotographic image forming apparatus including the process cartridge.

According to an aspect of the present invention, there is provided a process cartridge detachably mountable to a main assembly of an electrophotographic image forming apparatus, the process cartridge comprising:

an electrophotographic photosensitive member;

a first frame for supporting the electrophotographic photosensitive member;

a developer carrying member for developing an electrostatic latent image formed on the electrophotographic photosensitive member;

an opening, provided in the first frame, through which the electrophotographic photosensitive member is exposed;

a shutter, provided on the first frame, movable between an open position in which the opening is uncovered and a closed position in which the opening is covered; and a spacer member movably provided on the shutter, wherein when the shutter is located at the closed position, the spacer member is movable to a spacing position in which the spacer member is between the electrophotographic photosensitive member and the developer carrying member to provide a spacing between the electrophotographic photosensitive member and the developer carrying member, and a retracted position in which the opening is covered with the spacer member.

According to another aspect of the present invention, there is provided an electrophotographic image forming apparatus for forming an image on a recording material, comprising:

(i) a process cartridge detachably mountable to a main assembly of an electrophotographic image forming apparatus, the process cartridge comprising:

an electrophotographic photosensitive member;

a first frame for supporting the electrophotographic photosensitive member;

a developer carrying member for developing an electrostatic latent image formed on the electrophotographic photosensitive member;

an opening, provided in the first frame, through which the electrophotographic photosensitive member is exposed;

a shutter, provided on the first frame, movable between an open position in which the opening is uncovered and a closed position in which the opening is covered; and a spacer member movably provided on the shutter, wherein when the shutter is located at the closed position, the spacer member is movable to a spacing position in which the spacer member is between the electrophotographic photosensitive member and the developer carrying member to provide a spacing between the electrophotographic photosensitive member and the developer carrying member, and a retracted position in which the opening is covered with the spacer member;

(ii) a transfer member for transferring a developer image, obtained by developing the electrostatic latent image by the developer carrying member, onto the recording material; and (iii) a fixing device for fixing the developer image, transferred on the recording material, on the recording material.

These and other objects, features and advantages of the present invention will become more apparent upon a consideration of the following description of the preferred embodiments of the present invention taken in conjunction with the accompanying drawings.

Figure 7:
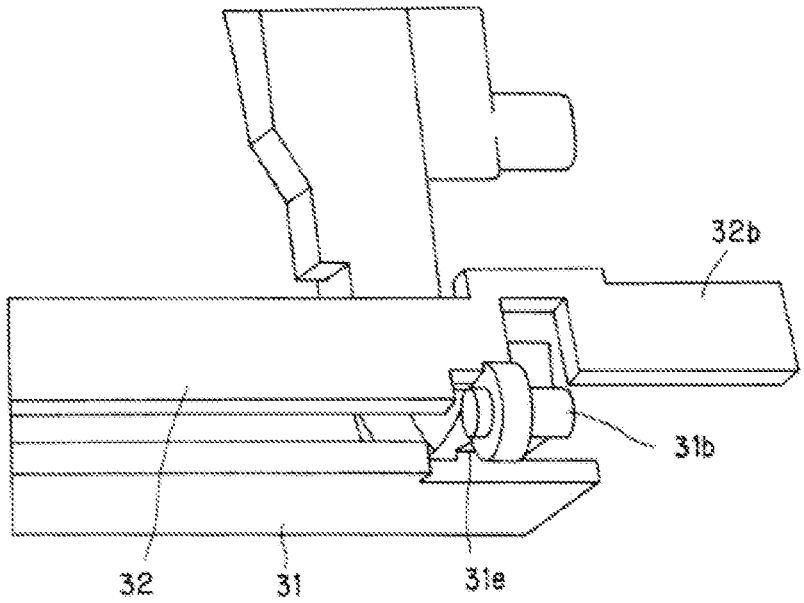
Figure 7:
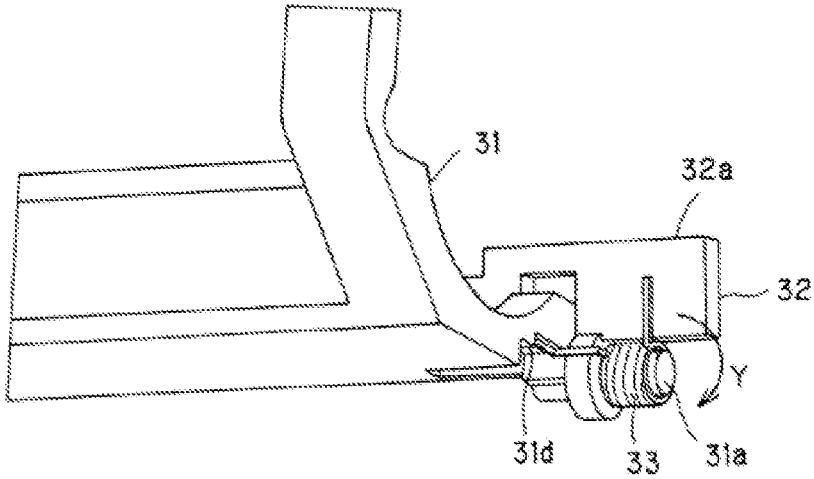

Parts (a) and (b) of FIG. 7 are schematic illustrations of the shutter and the spacer member in First Embodiment.

Figure 8:
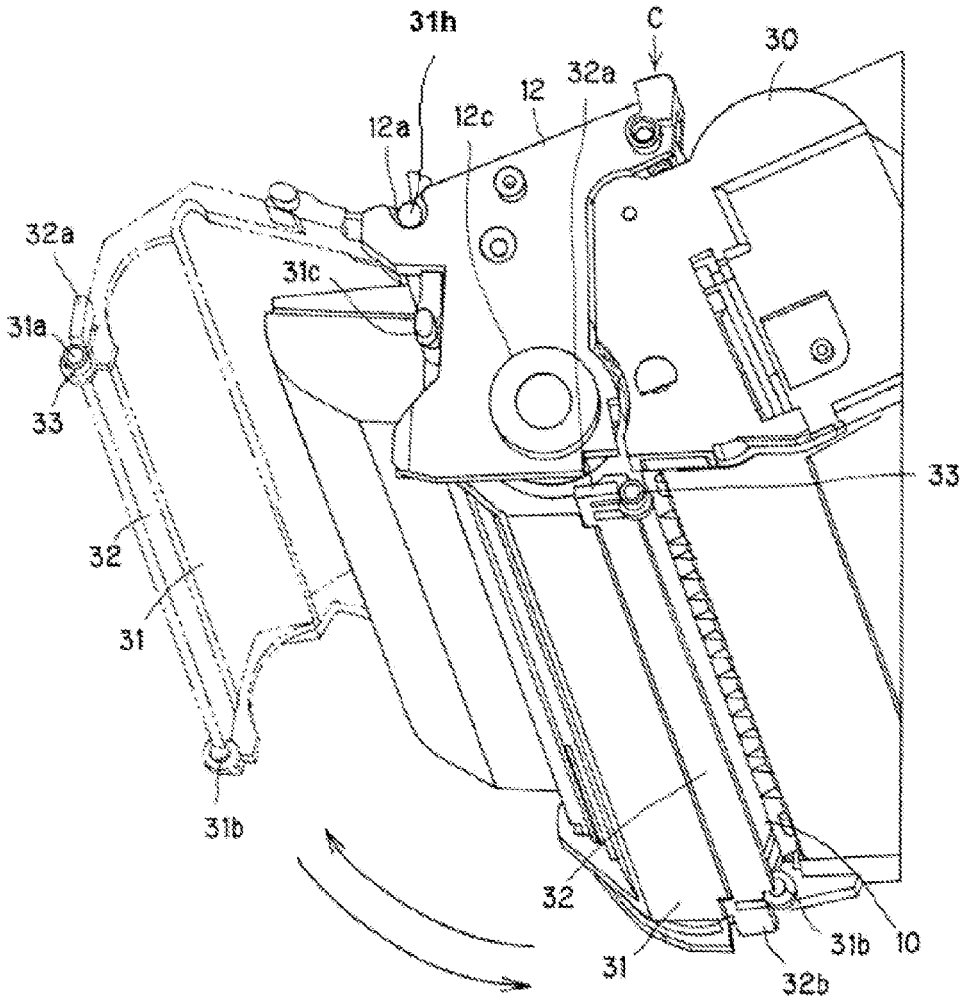

FIG. 8 is a perspective view for illustrating an opening and closing operation of the shutter in First Embodiment.

Figure 9:
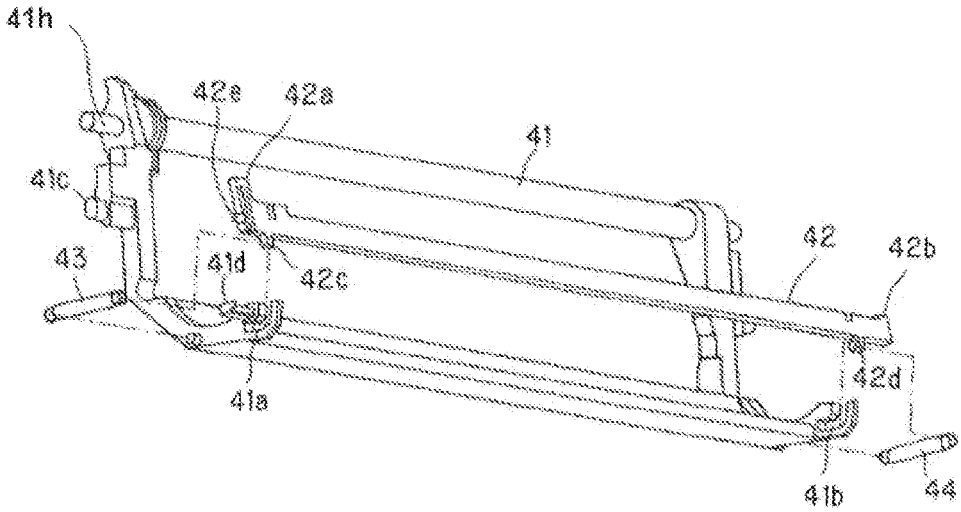

FIG. 9 is a perspective view for illustrating mounting of a shutter and a spacer member in Second Embodiment.

Figure 10:
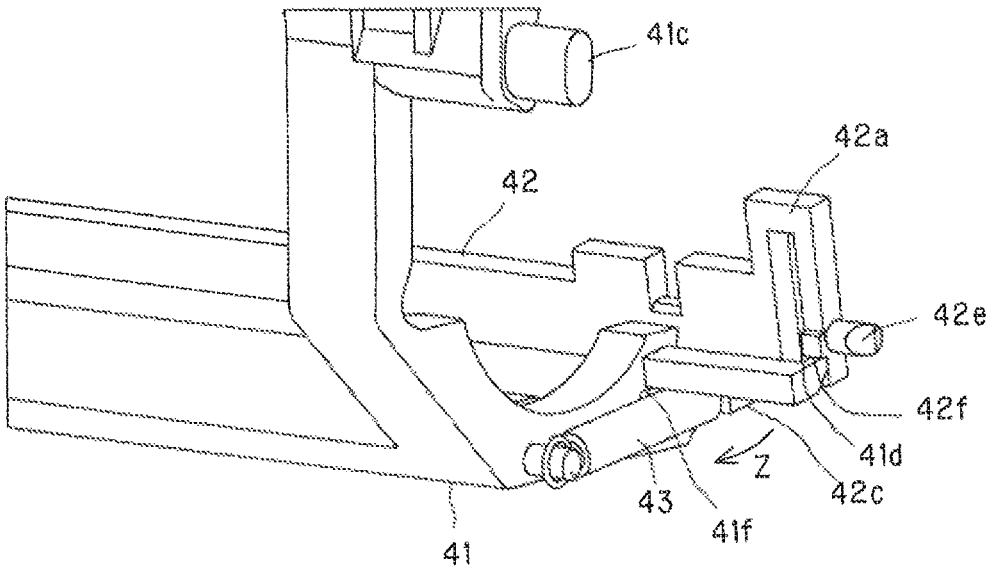
Figure 11:
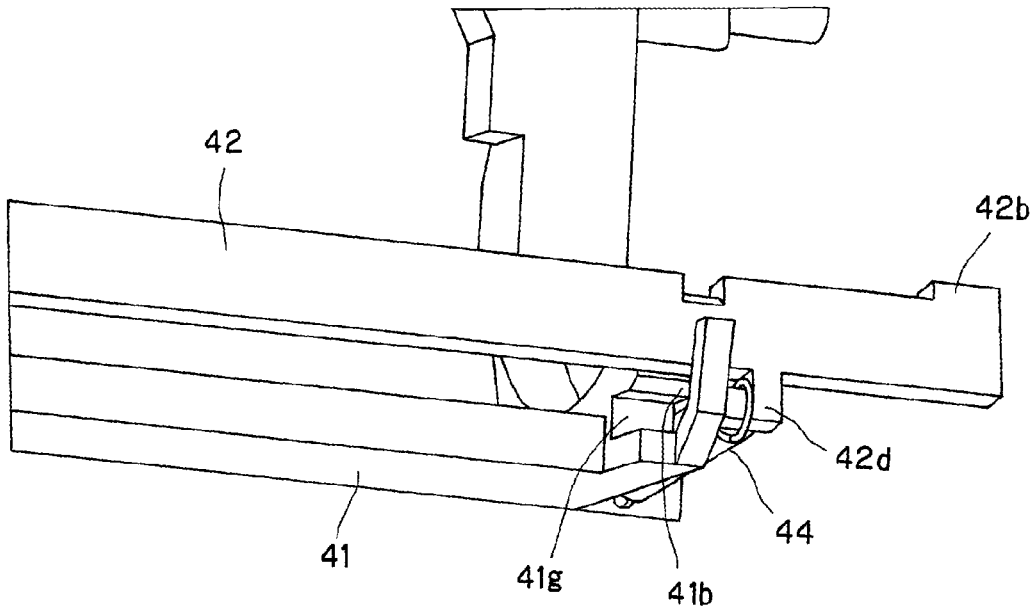

FIGS. 10 and 11 are schematic illustrations of the shutter and the spacer member in Second Embodiment.

Figure 12:
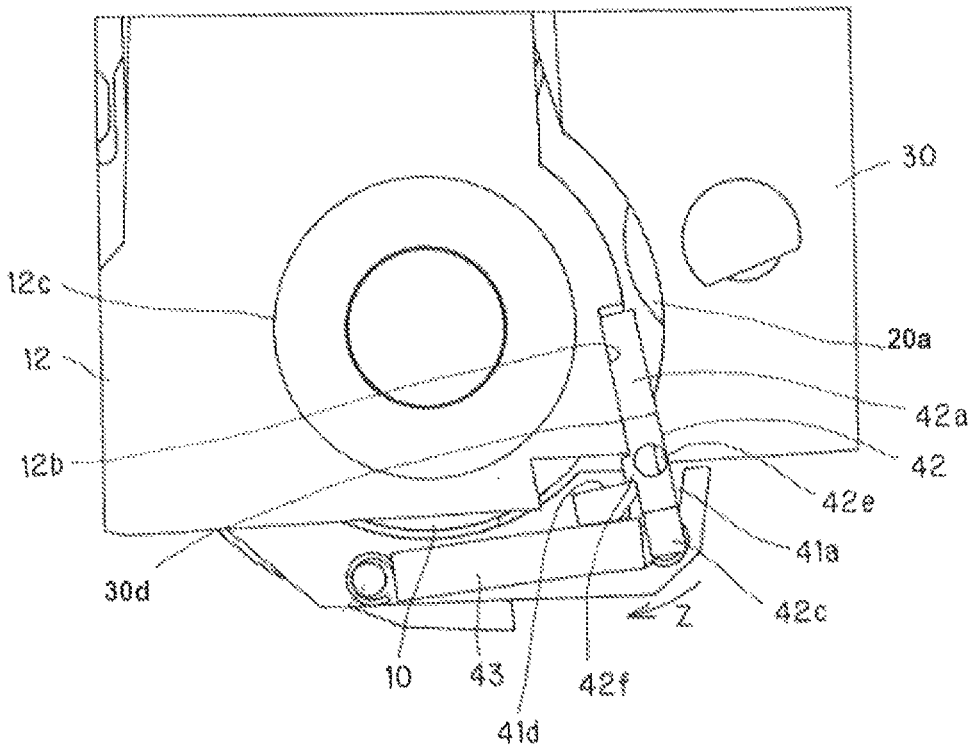

FIG. 12 is a side view of the spacer member in Second Embodiment.

Figure 13:
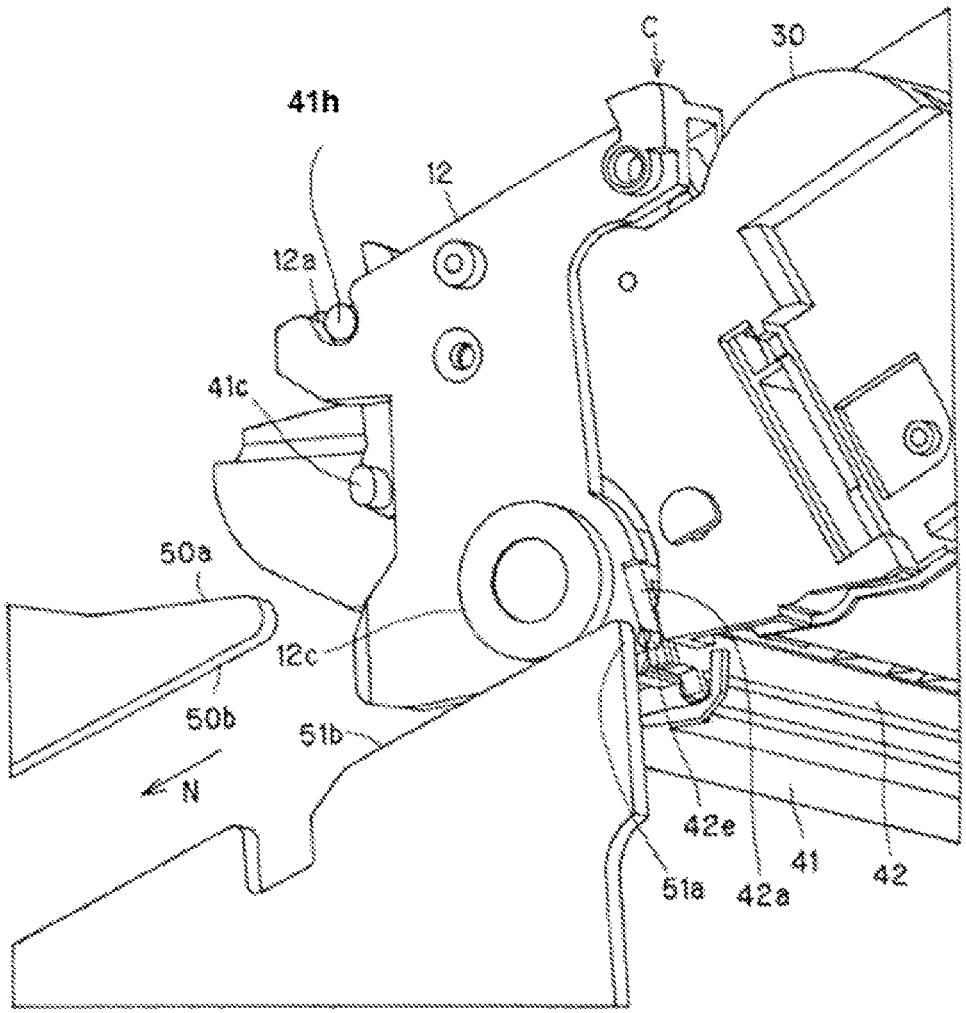

FIG. 13 is a perspective view for illustrating mounting of a process cartridge according to Second Embodiment.

Figure 14:
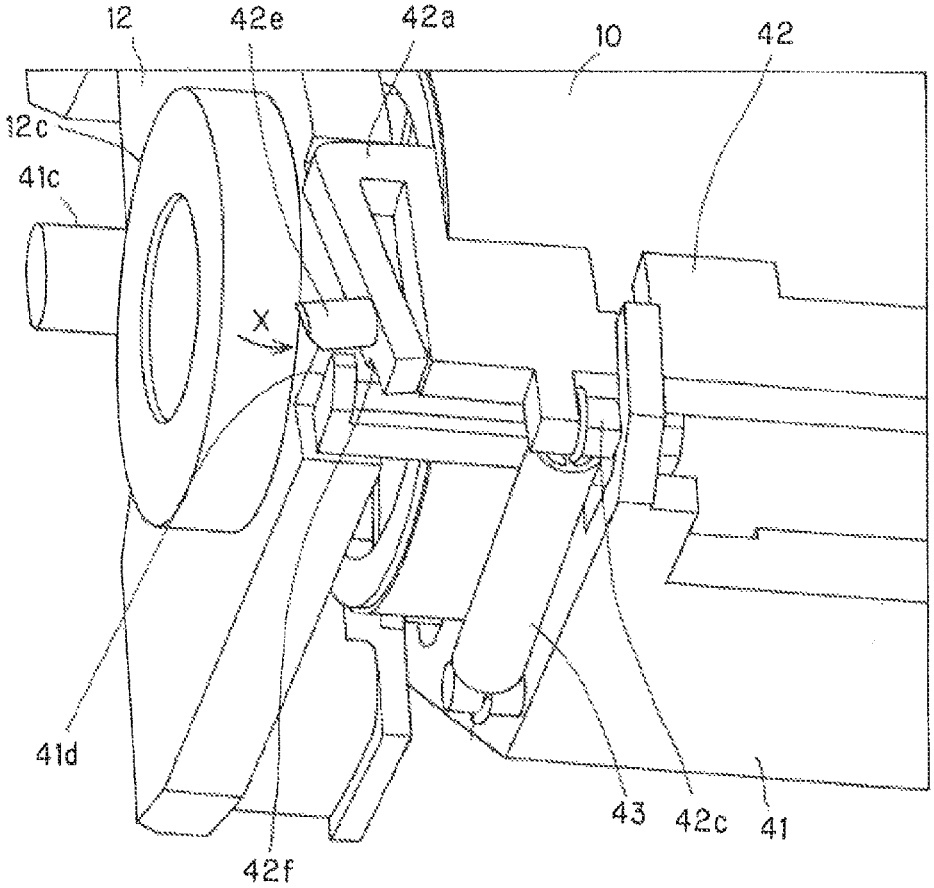

FIG. 14 is a perspective view for illustrating lock-releasing of the spacer member in Second Embodiment.

Figure 15:
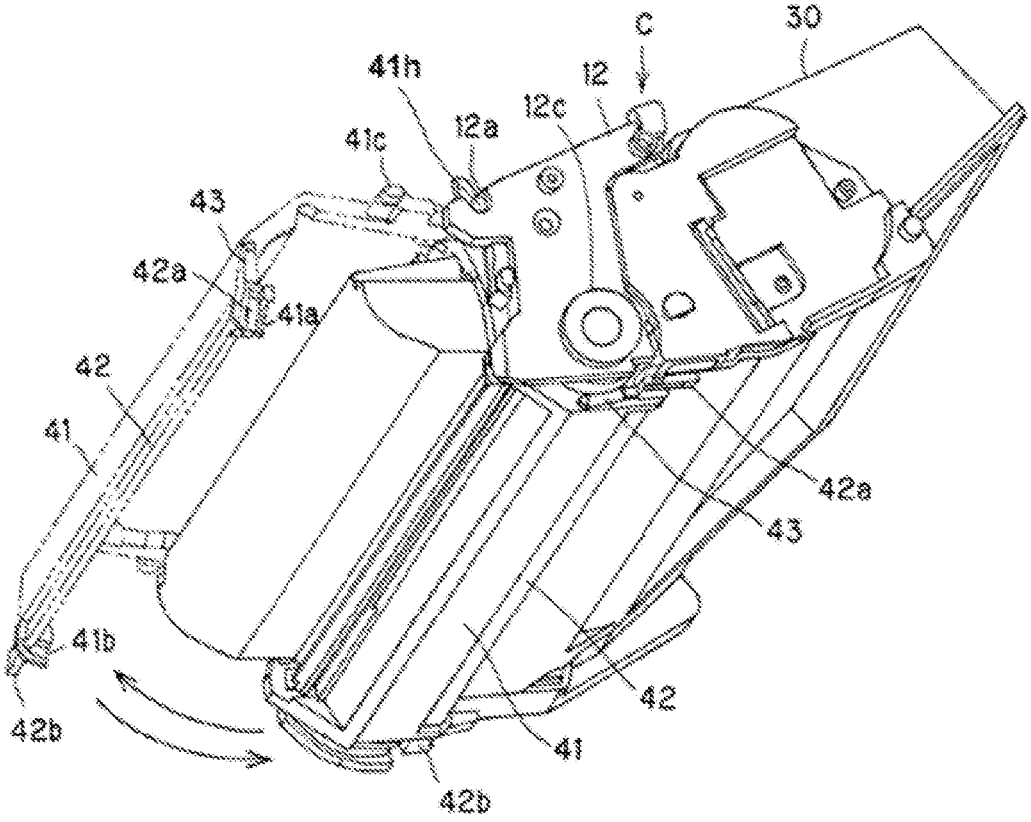

FIG. 15 is a perspective view for illustrating an opening and closing operation of the shutter in Second Embodiment.

Figure 16:
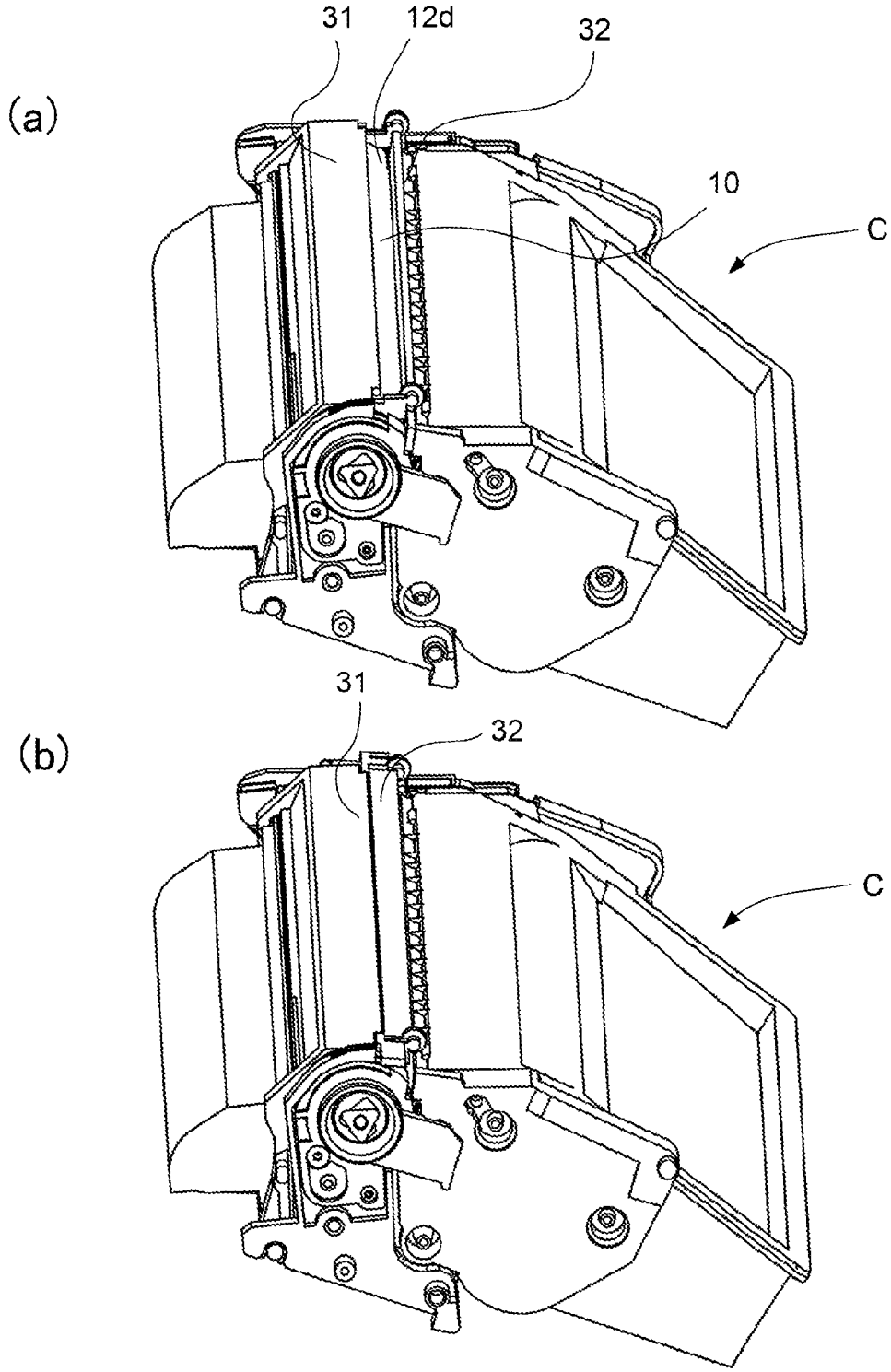

Parts (a) and (b) of FIG. 16 are perspective views each for illustrating the spacer member in First Embodiment.

Figure 17:
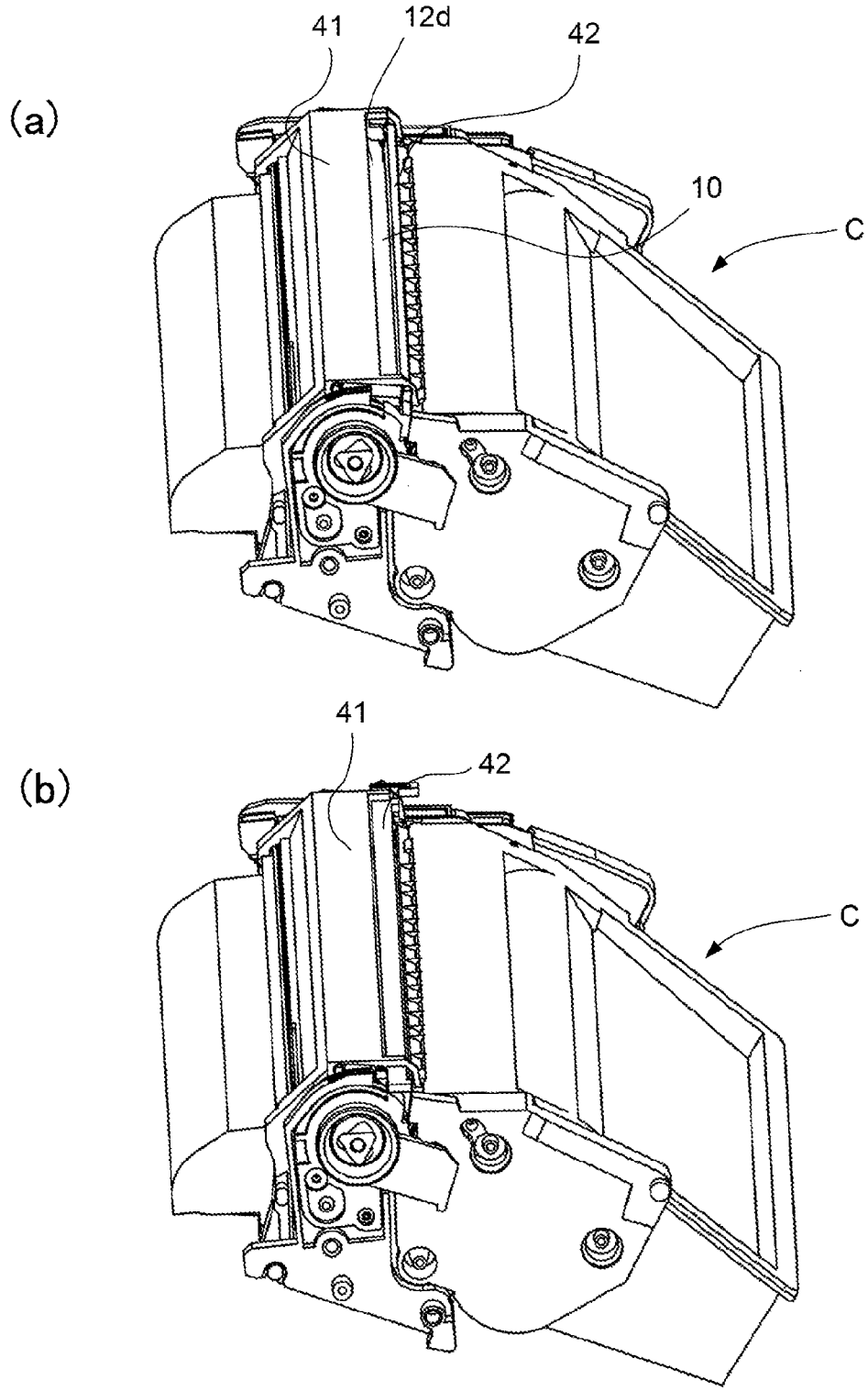

Parts (a) and (b) of FIG. 17 are perspective views each for illustrating the spacer member in Second Embodiment.

DESCRIPTION OF THE PREFERRED EMBODIMENTS

First Embodiment

With reference to FIGS. 1 to 8, a process cartridge and electrophotographic image forming apparatus according to First Embodiment to which the present invention is applicable will be described. In the following description, an "apparatus main assembly" refers to a structure as a part of the image forming apparatus from which the cartridge is removed.

(1-1: General Structure of Image Forming Apparatus)

Figure 2:
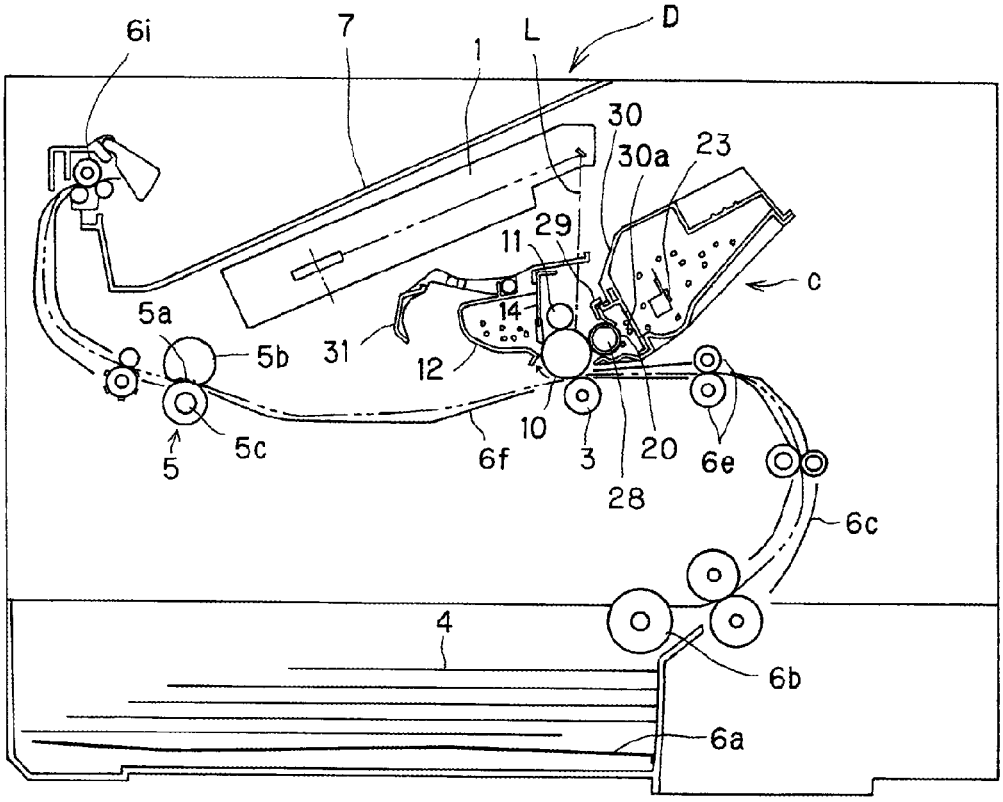
FIG. 2 is a schematic illustration of an electrophotographic image forming apparatus according to First Embodiment.

With reference to FIG. 2, a general structure of the image forming apparatus according to this embodiment will be described. In this embodiment, the image forming apparatus is a laser beam printer in which scanning exposure is effected by laser light and an image is formed on a recording material 4 (a sheet material, recording paper, an OHP sheet, a cloth or the like).

The image forming apparatus includes a cartridge C which integrally includes a photosensitive drum 10 (electrophotographic photosensitive member), a charging roller 11, a developing roller 20 (developer carrying member), a cleaning blade 14 and the like. The cartridge C is detachably mountable to an apparatus main assembly D of the image forming apparatus and will be described later in detail. Further, above the cartridge C, an exposure unit 1 is provided.

When an image forming process is started, the photosensitive drum 10 uniformly charged by the charging roller 11 to the same polarity as a charge polarity of toner (developer) is irradiated with laser light L emitted from the exposure unit 1 and modulated on the basis of image information, thus being subjected to scanning exposure. As a result, an electrostatic latent image is formed on the photosensitive drum 10. Then, the toner is supplied from the developing roller 20 to the electrostatic latent image, as that the electrostatic latent image is developed into a toner image (developer image). The thus formed toner image is transferred onto the recording material in a nip (transfer position) between the photosensitive drum 10 and a transfer roller 3 (transfer member) disposed opposed to the photosensitive drum 10, by applying a voltage, of an opposite polarity to the toner charge polarity, to the transfer roller 3. The recording material 4 is accommodated in a feeding cassette 6*a* provided at a lower portion of the apparatus main assembly D, and the accommodated recording material 4 is fed and conveyed to the transfer position by being timed to a pick-up roller 6*b*, a conveyance guide 6*c* and a registration roller pair 6*e*.

The recording material 4 on which the toner image is transferred is conveyed to a fixing device 5 while being guided by a conveyance guide 6*f*. The fixing device 5 includes a fixing sleeve 5*b* including a heater 5*a* and includes a pressing roller 5*c* contactable to the fixing sleeve 5*b*, and can heat the toner image on the recording material 4 in a nip between the fixing sleeve 5*b* and the pressing roller 5*c*. As a result, the toner image can be fixed, under heat and pressure, on the recording material 4 which passes through the nip. The recording material 4 on which the toner image is fixed is discharged from a discharging roller 6*i* onto a discharge tray 7.

(1-2: General Structure of Process Cartridge)

Figure 3:
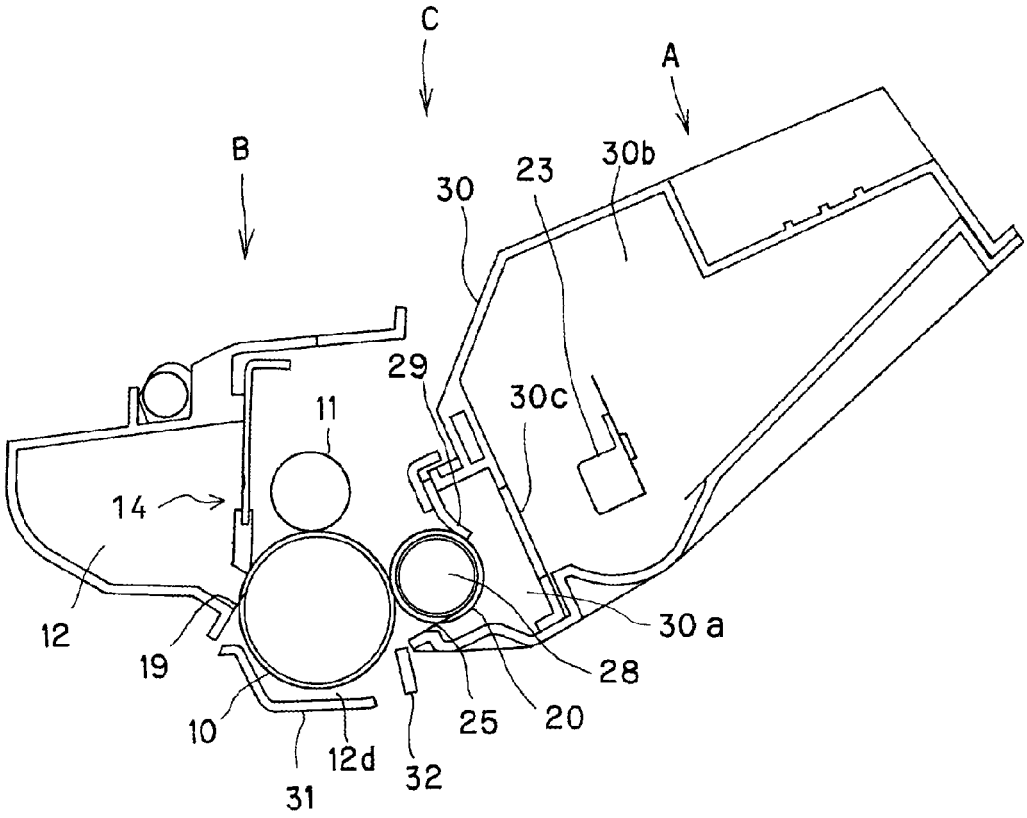
FIG. 3 is a schematic illustration of a process cartridge according to First Embodiment.

With reference to FIG. 3, a general structure of the cartridge C in this embodiment will be described. The cartridge C roughly includes a developing unit A and a drum unit B.

The developing unit A includes a developing device frame 30 in which a developing chamber 30*a* and a developer accommodated chamber 30*b*. In the developing chamber 30*a*, the developing roller 20 which contains a fixed magnet 28, and a regulating blade 29 for regulating a layer thickness of and triboelectrically charging the toner carried on the surface of the developing roller 20 by being contacted to the surface of the developing roller 20 are provided. In a gap at a portion where the developing roller 20 is exposed from the developing device frame 30, a leakage-preventing sheet 25 for preventing toner leakage is provided.

In the developer accommodating chamber 30*b*, a toner feeding member 23 for stirring the accommodated toner and for feeding the toner to the developing chamber 30*a* is provided. Further, the developing chamber 30*a* and the developer accommodating chamber 30*b* communicate with each other through an opening 30*c*. Through this opening 30*c*, the toner can be fed to the developing chamber 30*a*.

On the other hand, the photosensitive drum 10, the charging roller 11 and the cleaning blade 14 are supported by a residual toner container 12 constituting a frame in the drum unit B. The charging roller 11 is rotated by rotation of the photosensitive drum 10, and the cleaning blade 14 is contacted to the surface of the photosensitive drum 10 to remove residual toner remaining on the surface of the photosensitive drum 10 after the transfer. The removed toner is collected in the residual toner container 12. In order to prevent scattering of the collected toner to the outside, between the photosensitive drum 10 and the residual toner container 12, a receptor sheet 19 is provided upstream of the cleaning blade 14 with respect to a rotational direction of the photosensitive drum 10. According to the cartridge C having such a constitution, the toner is supplied from the developing roller 20 to the surface of the photosensitive drum 10 by applying a developing voltage, of the same polarity as the toner charge polarity, to the developing roller 20 and thus the electrostatic latent image can be developed into the toner image.

In this embodiment, to the residual toner container 12 which is a first frame f the cartridge C, the developing device frame which is a second frame of the cartridge C is rotatably connected. Further, the developing roller 20 is urged toward the photosensitive drum 10 by an urging spring (not shown). Further, a distance (gap) between the surface of the developing roller 20 and the surface of the photosensitive drum 10 is set at 200 μm to 300 μm by the medium of a spacer roller 20*a* (FIG. 1) provided on the developing roller 20. The spacer roller 20*a* is provided at each of end portions of the developing roller 20 with respect to a longitudinal direction of the developing roller 20. During the development (during the image formation, on the basis of a difference (developing contract) between a light-portion potential of the electrostatic latent image formed on the photosensitive drum 1 and the developing voltage applied to the developing roller 20, the charged toner jumps toward the surface of the photosensitive drum 10 in the gap described above.

(1-3: General Structure of Shutter)

Figure 4:
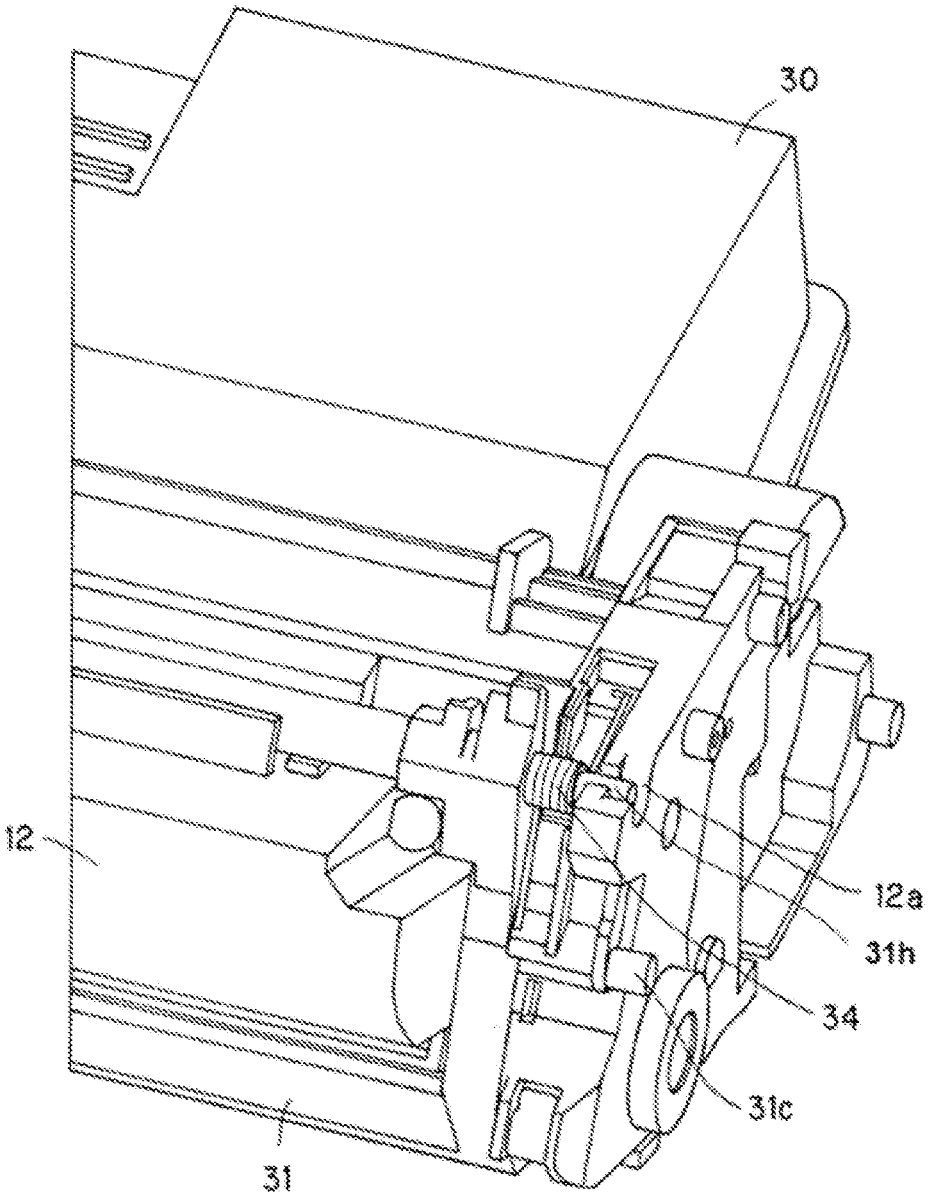
FIG. 4 is a perspective view of the process cartridge according to First Embodiment.
Figure 5:
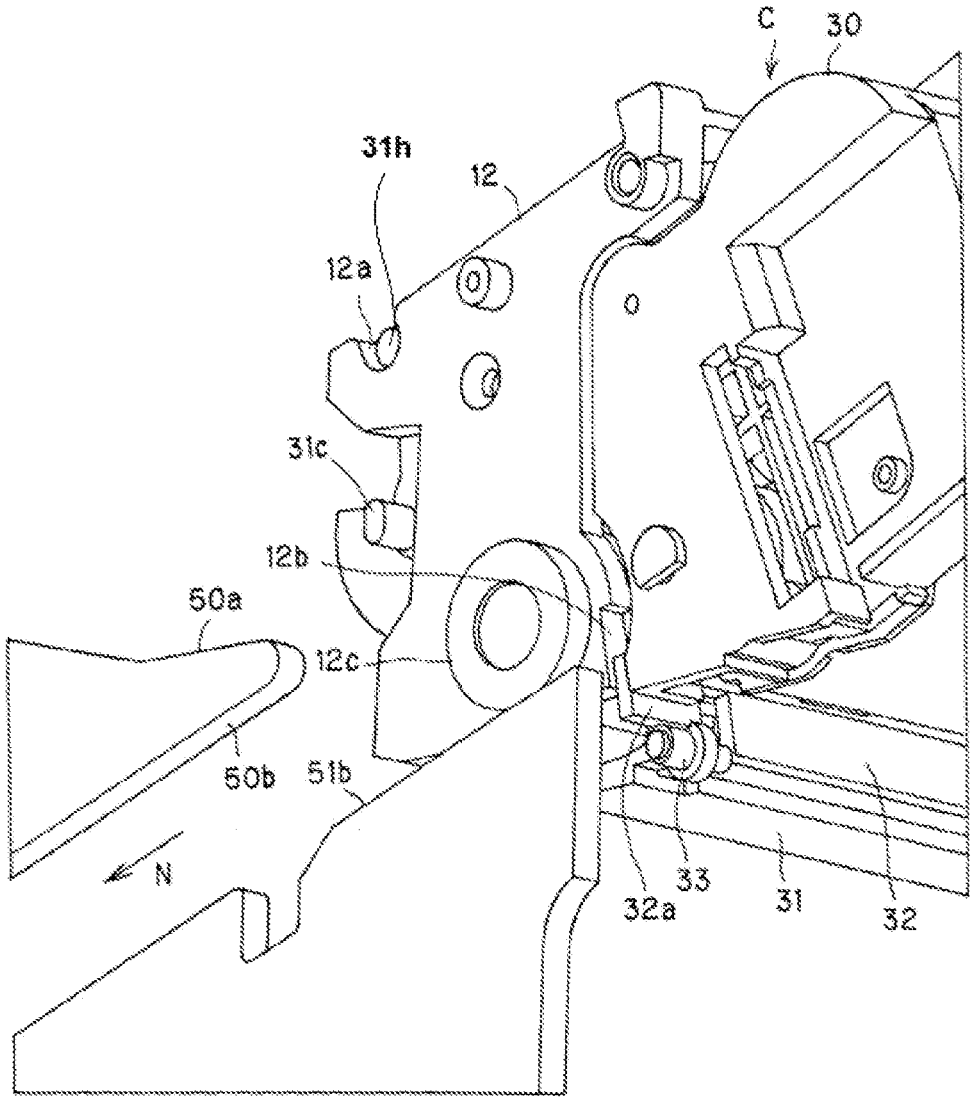
FIG. 5 is a perspective view for illustrating mounting of the process cartridge according to First Embodiment.

With reference to FIGS. 2 to 5, a shutter 31 in this embodiment will be described. FIG. 4 is a perspective view of the cartridge C and FIG. 5 is a perspective view for illustrating mounting of the cartridge C.

As shown in FIG. 2, in a state in which the cartridge C is mounted in the apparatus main assembly D of the image forming apparatus, a part of a peripheral surface of the photosensitive drum 10 is exposed, and at an exposed portion, the photosensitive drum 10 opposes the transfer roller 3. In this embodiment, the frame of the residual toner container 12 is provided with an opening 12*d* (FIG. 3) through which the photosensitive drum 10 is to be exposed during the image formation.

However, in a state in which the cartridge C is removed from the apparatus main assembly D, there is a possibility that dust or the like enters the inside of the cartridge C through the opening 12*d* and is deposited on the surface of the photosensitive drum 10 and other parts inside the cartridge C. Therefore, in this embodiment, the shutter 31 which is movable to an open position in which the opening 12*d* is opened (uncovered) by the shutter 31 in the state in which the cartridge C is mounted in the apparatus main assembly D and to a closed position in which the opening 12*d* is covered with the shutter 31 in the state in which the cartridge C is removed from the apparatus main assembly D is provided on the cartridge C. Thus, the shutter 31 is movable between the open position and the closed position. The general structure of the shutter 31 will be described below.

As shown in FIG. 4, a shaft 31*h* provided on the shutter 31 is rotatably supported by a bearing 12*a* provided on the frame of the residual toner container 12. As a result, the shutter 31 is supported by the residual toner container 12 and can uncover (open) and cover (close) the opening 12*d*. Further, the shaft 31*h* of the shutter 31 is provided with a helical (torsion) coil spring 34. By the action of the helical coil spring 34, the shutter 31 is always urged in a direction in which the opening 12*d* is covered with the shutter 31. That is, in the state in which the cartridge C is removed from the apparatus main assembly D, the shutter 31 is always in the state in which the opening 12*d* is covered with the shutter 31.

With reference to FIG. 5, a process in which the shutter 31 is opened will be described. When the cartridge C is mounted in the apparatus main assembly D, a cartridge guiding portion 12*c* shown in FIG. 5 is inserted into the apparatus main assembly D in a direction indicated by an arrow N while being moved along an upper guide portion 50*b* and a lower guide portion 51*b* which are provided at the apparatus main assembly D side. At this time, a shutter opening and closing guide portion 31*c* provided on the shutter 31 is urged by a shutter opening and closing guide 50*a* provided at the apparatus main assembly D side, so that the shutter 31 is moved from the closed position to the open position together with the insertion of the cartridge C. Here, the shutter opening and closing guide portion 31*c* is an engaging portion which is engageable with the apparatus main assembly D and is capable of moving the shutter 31 from the closed position to the open position.

In a state in which the cartridge C is inserted and positioned at a predetermined position of the apparatus main assembly D, the shutter 31 is located at the open position to place the opening 12*d* in an open (uncovered) state, so that the photosensitive drum 10 opposes the transfer roller 3. Incidentally, in this state, the shutter opening and closing guide portion 31*c* is always urged by the shutter opening and closing guide 50*a*, so that the shutter 31 is not closed by the action of the helical coil spring 34.

(1-4: General Structure of Spacer Member)

Figure 1:
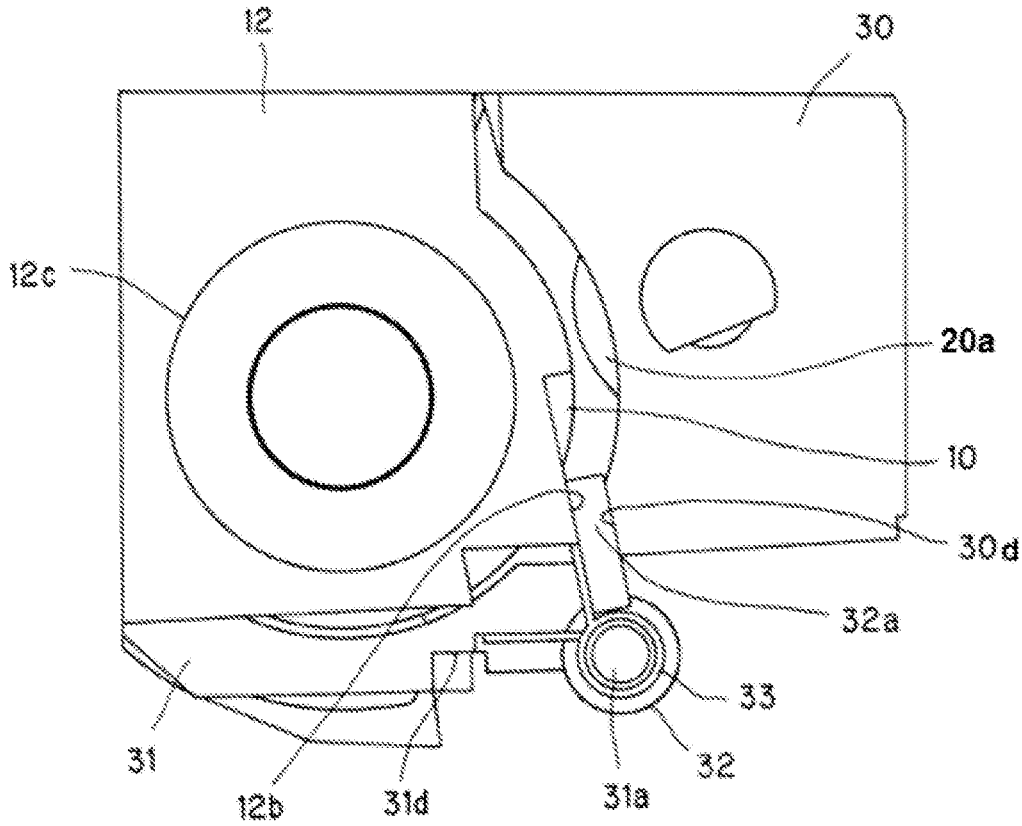
FIG. 1 is a side view of a spacer member in First Embodiment.
Figure 6:
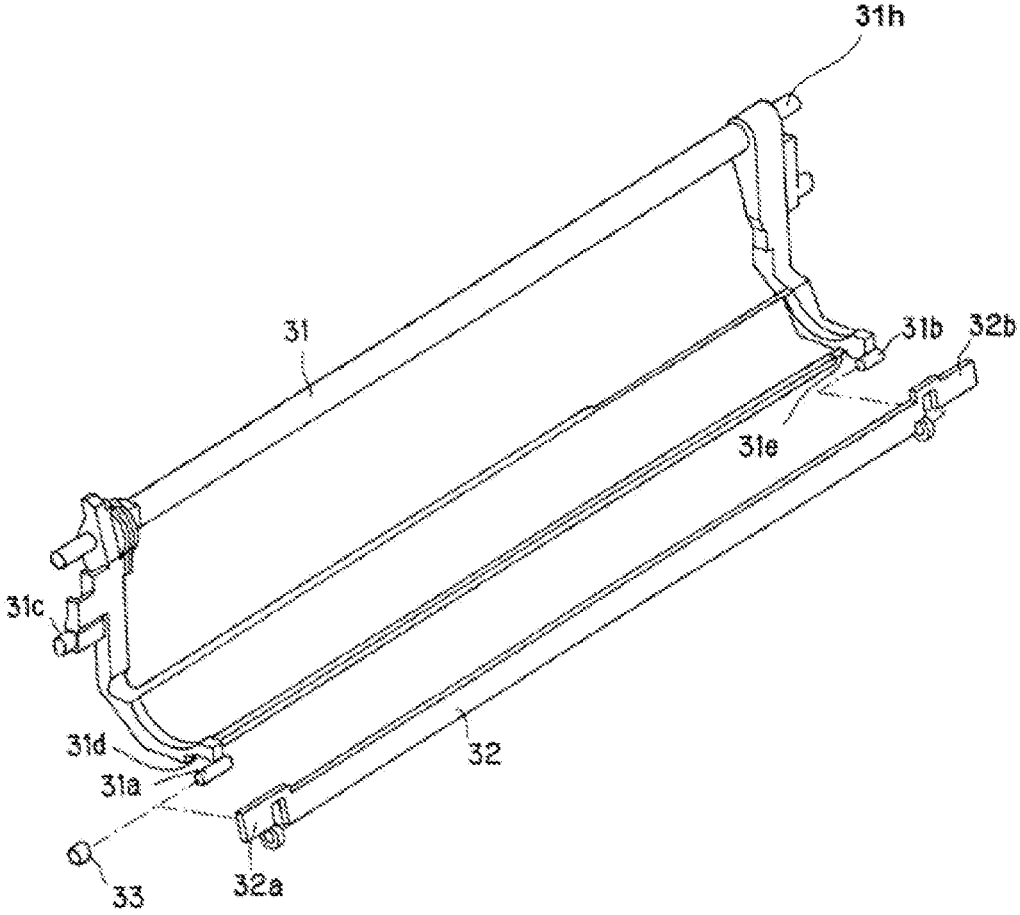
FIG. 6 is a perspective view for illustrating mounting of a shutter and a spacer member in First Embodiment.

With reference to FIGS. 1 and 6 to 8, a general structure of a spacer member 32 in this embodiment will be described. FIG. 1 is a side view of the spacer member 32, FIG. 6 is a perspective view for illustrating mount of the spacer member 32, (a) and (b) of FIG. 7 are schematic illustrations of the spacer member 32, and FIG. 8 is a perspective view for illustrating an opening and closing operation of the shutter.

In this embodiment, in the case where the cartridge C is transported alone, the spacer member 32 for spacing the spacer roller 20*a*, which is spacing member between the photosensitive drum 10 and the developing roller 20, from the surface of the photosensitive drum 10 to increase a spacing between the surface of the photosensitive drum 10 and the surface of the developing roller 20 is used. As a result, it is possible to reduce a possibility of damage of the surface of the photosensitive drum 10 by the contact of the surface of the developing roller 20 and the spacer roller 20*a* to the surface of the photosensitive drum 10 due to vibration or impact during packing, transportation and the like. A state in which the spacing between the photosensitive drum 10 surface and the developing roller 20 surface is increased by the spacer member 32 and then is kept, i.e., a state in which the spacer roller 20*a* is spaced from the photosensitive drum 10 surface is referred to as a "spaced state", The spacer member 32 is mounted at an end of the shutter 31 and is constituted so that the spaced state by the spacer member 32 is eliminated by start of an opening operation of the shutter 31 during mounting of the cartridge C. The general structure of the spacer member 32 will be described below.

As shown in FIG. 6 and (a) and (b) of FIG. 7, at an end of the shutter 31, engaging portions 31*a* and 31*b* projected in a direction (rotational axis direction of the shutter 31) perpendicular to an opening and closing direction of the shutter 31 are provided. By engagement of these engaging portions 31*a* and 31*b* with mounting holes of the spacer member 32, the spacer member 32 can be rotatably mounted on the shutter 31. The one engaging portion 31*a* of the shutter 31 is provided with a helical coil spring 33 which is a helical urging member. By the action of this helical coil spring 33, as shown (b) of FIG. 7, the spacer member 32 is always urged in a direction indicated by an arrow Y. Incidentally, the helical coil spring 33 is not provided on the other engaging portion 31*b* ((a) of FIG. 7) of the shutter 31.

Before the cartridge C is mounted in the apparatus main assembly D, spacer portions 32*a* and 32*b* (FIG. 6) provided at both ends of the spacer member 32 are interposed between an insertion portion 30*d* formed on the developing device frame 30 and an insertion portion 12*b* formed on the residual toner container 12 (spaced state). This state is shown in FIG. 1. The developing device frame 30 holds the developing roller 20, and the frame of the residual toner container 12 holds the photosensitive drum 10. For that reason, by the interposition of the spacer member 32 between the developing device frame 30 and the residual toner container 12, the spacing distance between the developing roller 20 and the photosensitive drum 10 is increased. Further, in this state, the spacer roller 20*a* is spaced from the photosensitive drum 10.

When the cartridge C is mounted, the shutter 31 is opened by the above-described process. The spacer member 32 is mounted at the end of the shutter 31 and thus when the shutter 31 is started to be opened, the spacer member 32 is correspondingly escaped from between the insertion portions 30*d* and 12*b*. Thus, the spaced state between the photosensitive drum 10 and the spacer roller 20*a* is eliminated and the spacer roller 20*a* is contacted to the photosensitive drum 10 surface, so that the spacing between the developing roller 20 and the photosensitive drum 10 is narrowed to a spacing with which the image can be formed.

When the spacer member 32 is escaped from the insertion portions 30*b* and 12*b*, the spacer member 32 is rotated by the action of the helical coil spring 33 ((b) of FIG. 7). At this time, the spacer member 32 is rotated until it is contacted to abutting portions 31*d* and 31*e* provided on the shutter 31. That is, the spacer member 32 is moved from a spacing position in which the spacing between the photosensitive drum 10 and the developing roller 20 is increased as shown in (a) of FIG. 16 to a retracted position in which the opening 12*d* is covered with the spacer member 32 as shown in (b) of FIG. 16 (i.e., placed in a retracted state). Here, (a) of FIG. 16 is a schematic view showing the process cartridge is the case where the spacer member 32 is located at the spacing position, and (b) of FIG. 16 is a schematic view showing the process cartridge in the case where the spacer member 32 is located at the retracted position.

When the spacer member 32 is moved to the retracted position, as shown in FIG. 8, an area in which the spacer member 32 passes by movement of the shutter 31 overlaps with an area in which the shutter 31 passes in the case where these areas are viewed from the rotational axis direction of the shutter 31.

As a result, when the cartridge C is mounted in the apparatus main assembly D, it is possible to reduce a space in which the spacer member 32 passes through the inside of the apparatus main assembly D.

That is, in general, when the shutter is opened in the constitution in which the spacer member is provided at the end of the shutter, a movement locus (rotation locus) of the shutter end is increased by a length of the spacer member. For that reason, there is a need to separately ensure a space for permitting passing of not only the shutter but also the spacer member inside the apparatus main assembly. As a result, the image forming apparatus is increased in size. However, in this embodiment, in the case where the cartridge C is viewed from the rotational axis direction of the shutter 31, the spacer member 32 passing area is constituted so as to fall within the shutter 31 end passing locus (including the shaft 31*h* of the shutter 31). For that reason, there is no need to separately provide the space for permitting the passing of the spacer member 32 inside the apparatus main assembly D.

Further, when the cartridge C mounted in the apparatus main assembly D is removed from the apparatus main assembly D, the shutter 31 moves to the closed position in which it covers the opening 12*d* in a state in which the spacer member 32 is kept in the retracted state. At this time, the spacer member 32 placed in the retracted state can cover the opening 12*d* together with the shutter 31. Therefore, as shown in (b) of FIG. 16, a protection range for the photosensitive drum 10 is enlarged. That is, as shown in (a) of FIG. 16, when the spacer member 32 is located at the retracted position, a part of the photosensitive drum 10 is not covered with the shutter 31 but is exposed. However, as shown in (b) of FIG. 16, when the spacer member 32 is moved to the retracted position, the spacer member 32 covers the area in which the part of the photosensitive drum 10 is exposed. As a result, it is possible to further decrease the possibility that dust or the like enters the inside of the cartridge C through the opening 12*d* and is deposited on the photosensitive drum 10 and other parts in the cartridge C.

As a result, it becomes possible to protect a wide range of the photosensitive drum 10 by the shutter 31 and the spacer member 32 without increasing the size of the shutter 31. Incidentally, during the transportation of the cartridge C, the spacer member cartridge 32 is located at the spacing position and therefore the part of the photosensitive drum 10 is exposed through the opening 12*d*. However, in this case, the photosensitive drum 10 may be protected by packing the cartridge C in a bag or the like.

(1-5: Effect in this Embodiment)

According to this embodiment, when the cartridge C is transported alone, the spacer roller 20*a* of the developing roller 20 can be spaced from the photosensitive drum 10 by the spacer member 32, and the spacing between the photosensitive drum 10 surface and the developing roller 20 surface can be increased. Therefore, even when the impact or the like is exerted on the cartridge C, it is possible to prevent the photosensitive drum 10 surface from being damaged by the contact of the developing roller 20 or the spacer roller 20*a* to the photosensitive drum 10 surface.

Further, when the cartridge C is mounted in the apparatus main assembly D, the spacer member 32 is moved to the retracted position and therefore even when the shutter 31 is moved from the closed position to the open position, the passing area in which the spacer member 32 moves overlaps with the passing area of the shutter 31. Thus, the increase in space necessary to permit the passing of the spacer member 32 inside the apparatus main assembly D is suppressed, so that the image forming apparatus can be downsized. Particularly, in this embodiment, in the case where the cartridge C is viewed from the rotational axis direction of the shutter 31, the passing area of the spacer member 32 is contacted so as to fall within the shutter 31 end passing locus. In the case where when the passing area of the spacer member 32 at the retracted position is caused to at least partly overlap with the passing area of the shutter 31 in the case where the cartridge C is viewed from the rotational axis direction, it becomes possible to suppress the increase in space necessary to permit the passing of the spacer member 32. As a result, the image forming apparatus can be decreased in size.

Further, a user is not required to directly remove the spacer member 32 from between the insertion portions 12*b* and 30*d* and to remove the spacer member 32 from the shutter 31.

Further, when the spacer member 32 is once placed in the retracted state, then the opening 12*d* is covered with the shutter 31 and the spacer member 32 every removal of the cartridge C. Therefore, when paper jam or the like occurs, in the case where the cartridge C is removed from the apparatus main assembly D, the photosensitive drum 10 or the like can be protected by using the spacer member 32.

As described above, according to this embodiment, in the process cartridge including the spacer member and in the electrophotographic image forming apparatus including the process cartridge, the electrophotographic photosensitive member can be protected by the spacer member of which spaced state between the electrophotographic photosensitive member and the developer carrying member is eliminated.

Second Embodiment

With reference to FIGS. 9 to 15, a process cartridge and electrophotographic image forming apparatus according to Second Embodiment to which the present invention is applicable will be described. In this embodiment, the general structure and the like of the image forming apparatus identical in constitution to those in First Embodiment are represented by the same reference numerals or symbols and will be omitted from the description. In this embodiment, only a constitution different from that in First Embodiment will be described.

(2-1: General Structure of Shutter)

FIG. 9 is a perspective view for illustrating mount of a shutter 41 and a spacer member 42.

In this embodiment, a shaft 41*h* provided on the shutter 41 is rotatably supported by a bearing 12*a* (FIG. 15) provided on the frame of the residual toner container 12 similarly as in First Embodiment. Further, by the action of the helical coil spring (not shown) provided on the shaft 41*h*, the shutter 41 is always urged in a direction in which the opening 12*d* is covered with the shutter 31 similarly as in First Embodiment. That is, in the state in which the cartridge C is removed from the apparatus main assembly D, the shutter 41 always covers the opening 12*d*.

Further, during the mounting of the cartridge C, a shutter opening and closing guide portion 41*c* provided on the shutter 41 is urged against a shutter opening and closing guide (not shown) provided at the apparatus main assembly D side, so that the shutter 41 is opened by the insertion of the cartridge C.

(2-2: General Structure of Spacer Member)

The shutter 41 is provided with spacer member guide portions 41*a* and 41*b* at its end. The spacer member 42 is engaged with these spacer member guide portions 41*a* and 41*b*, so that the spacer member 42 is mounted on the shutter 41. Further, the spacer member 42 is provided with hooking portions 42*c* and 42*d* at its longitudinal ends. One end of a tension spring is engaged with a hooking portion 45 of the shutter 41 and the other end thereof is engaged with the hooking portion 42*c*. Similarly, another tension spring is engaged with the hooking portion 42*d* and a hooking portion (not shown) of the shutter 41. By this constitution, the spacer member 42 is always urged in a direction indicated by an arrow Z in FIG. 10.

On the other hand, during packing and transportation, each of spacer portions 42*a* and 42*b* provided on the spacer member 42 enters between the insertion portion 30*d* of the developing device frame 30 and the insertion portion 12*b* of the residual toner container 12. This state is shown in FIG. 12. As a result, the spacing between the developing roller 20 and the photosensitive drum 10 is increased, so that the spacer roller 20*a* is spaced from the photosensitive drum 10 surface.

When the spacer member 42 is kept in the spaced state, the spacer member 42 is locked at the spacing position against an urging force applied thereto from the tension springs 43 and 44. Each of FIGS. 10 to 12 shows the state in which the spacer member 42 is locked at the spacing position. The spacer member 42 is provided with a portion to be locked 42*f* at its one longitudinal end, and the portion to be locked 42*f* is locked by a locking portion 41*d* of the shutter 41. As a result, the spaced state by the spacer member 42 is prevented from being eliminated by impact generated due to drop or the like.

On the other hand, the spaced state by the spacer member 42 is eliminated in interrelation with the mounting operation of the cartridge C. That is, when the cartridge C is mounted in the apparatus main assembly D, a portion to be lock-released 42*e* (FIGS. 10 and 12) provided at one end of the spacer member 42, is contacted to a lock-releasing portion 51*a* provided on the apparatus main assembly D (FIG. 13). As a result, as shown in FIG. 14, the portion to be lock-released 42*e* is bent in a direction indicated by an arrow x (in the longitudinal direction of the spacer member 42), so that the lock between the portion to be locked 42*f* and the locking portion 41*d* is released.

As described above, the spacer member 42 is urged by the tension springs 43 and 44 and therefore when the lock by the shutter 41 is released, the spacer member 42 is pulled and thus the spacer member 42 slides along the guide portions 41*a* and 42*b* shown in FIG. 9. As a result, the spacer member 42 is escaped from between the insertion portions 12*b* and 30*d*, so that the spacer roller 20*a* and the photosensitive drum 10 are contacted to each other.

Here, FIG. 10 shows an abutting portion 41*f* provided at one end of the shutter 41, and FIG. 11 shows an abutting portion 41*g* provided at the other end of the shutter 41.

When the spacer member 42 slides along the guide portions 41*a* and 41*b*, the spacer member 42 is moved until it is abutted against the abutting portions 41*f* and 41*g* to be placed in a retracted state. That is, the spacer member 42 is moved from a spacing position in which the spacing between the photosensitive drum 10 and the developing roller 20 is increased as shown in (a) of FIG. 17 to a retracted position in which the opening 12*d* is covered with the spacer member 42 as shown in (b) of FIG. 17. Here, (a) of FIG. 17 is a schematic view showing the process cartridge is the case where the spacer member 42 is located at the spacing position, and (b) of FIG. 17 is a schematic view showing the process cartridge in the case where the spacer member 42 is located at the retracted position. After the spacer member 42 is moved to the spacing position, the shutter 41 is moved to the open position. Even when the shutter 41 is moved from the closed position to the open position in the state in which the spacer member 42 is retracted, as shown in FIG. 15, an area in which the spacer member 42 moves and passes overlaps with an area in which the shutter 41 passes in the case where these areas are viewed from the rotational axis direction of the shutter 41. Therefore, it is possible to suppress and increase in space required for permitting passing of the spacer member 42 inside the apparatus main assembly D. Particularly, in this embodiment, in the case where the cartridge C is viewed from the rotational axis direction of the shutter 41, the spacer member 42 passing area is constituted so as to fall within the shutter 41 end passing locus (including the shaft 41*h* of the shutter 41). In this case, there is no need to separately provide the space for permitting the passing of the spacer member 42 in the apparatus main assembly D.

Further, in a state in which the cartridge C is removed from the apparatus main assembly D and the shutter 41 moves to the closed position the opening 12*d* can be covered with the spacer member 42 in the retracted state and with the shutter 41. Therefore, as shown in (b) of FIG. 17, a protection range for the photosensitive drum 10 is enlarged. That is, as shown in (a) of FIG. 17, when the spacer member 42 is located at the retracted position, a part of the photosensitive drum 10 is exposed from the shutter 41. On the other hand, as shown in (b) of FIG. 17, when the spacer member 42 is moved to the retracted position, the spacer member 42, covers the area in which the part of the photosensitive drum 10 is exposed from the shutter 41.

(2-3: Effect in this Embodiment)

According to this embodiment, when the cartridge C is transported, the spacer roller 20*a* of the developing roller 20 can be spaced from the photosensitive drum 10 by the spacer member 42, and the spacing between the photosensitive drum 10 surface and the developing roller 20 surface can be increased. Therefore, even when the impact or the like is exerted on the cartridge C, it is possible to prevent the photosensitive drum 10 surface from being damaged by the contact of the developing roller 20 or the spacer roller 20*a* to the photosensitive drum 10 surface.

Further, when the cartridge C is mounted in the apparatus main assembly D and the shutter 41 is moved from the closed position to the open position, the passing area in which the spacer member 42 moves overlaps with and falls within the passing area of the shutter 41. Thus, the image forming apparatus can be decreased in size.

Further, a user is not required to directly remove the spacer member 42 from between the insertion portions 12*b* and 30*d* and to remove the spacer member 42 from the shutter 41.

Further, when the spacer member 42 is once placed in the retracted state, then the opening 12*d* is covered with the shutter 41 and the spacer member 42 every removal of the cartridge C from the apparatus main assembly D. Therefore, also in the case where the cartridge C is removed from the apparatus main assembly D, it is possible to reduce a possibility, that dust or the like is deposited on the photosensitive drum 10 surface, by the user of the spacer member 42. As a result, while downsizing the shutter 41, it becomes possible to protect the photosensitive drum 10 or the like by the spacer member 42 when the cartridge C is demounted from the apparatus main assembly D.

As described above, according to this embodiment, in the process cartridge including the spacer member and in the electrophotographic image forming apparatus including the process cartridge, the electrophotographic photosensitive member can be protected by the spacer member of which spaced state between the electrophotographic photosensitive member and the developer carrying member is eliminated.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 115377/2010 filed May 19, 2010 and 094121/2011 filed Apr. 20, 2011 which are hereby incorporated by reference.

What is claimed is:

1. A process cartridge detachably mountable to a main assembly of an electrophotographic image forming apparatus, said process cartridge comprising:

an electrophotographic photosensitive member;

a frame for supporting said electrophotographic photosensitive member;

a developer carrying member for developing an electrostatic latent image formed on said electrophotographic photosensitive member;

an opening, provided in said frame, through which said electrophotographic photosensitive member is exposed;

a shutter, provided on said frame, movable between an open position in which said opening is uncovered and a closed position in which said opening is covered; and a spacer member movably provided on said shutter, wherein when said shutter is located at the closed position, said spacer member is movable to a spacing position in which said spacer member is between said electrophotographic photosensitive member and said developer carrying member to provide a spacing between said electrophotographic photosensitive member and said developer carrying member, and a retracted position in which said opening is covered with said spacer member.

2. A cartridge according to claim 1, further comprising an urging member for urging said spacer member in a direction in which said spacer member is to be moved from the spacing position to the retracted position.

3. A cartridge according to claim 2, further comprising a second urging member for urging said shutter in a direction in which said shutter is moved from the open position to the closed position.

4. A cartridge according to claim 1, wherein said shutter is shaft-supported, and wherein an area in which said spacer member located at the retracted position passes by movement of said shutter at least partly overlaps, when said process cartridge is viewed from a rotational axis direction of said shutter, with an area in which said shutter passes.

5. A cartridge according to claim 1, wherein said shutter is shaft-supported, and wherein an area in which said spacer member located at the retracted position passes by movement of said shutter at least partly falls, when said process cartridge is viewed from rotational axis direction of said shutter, within an area ranging from a rotation axis of said shutter to an end of a passing locus of an end of said shutter.

6. A cartridge according to claim 1, wherein when said spacer member is located at the retracted position, by movement of said shutter from the closed position to the open position, said spacer member is moved from the spacing position to the retracted position.

7. A cartridge according to claim 1, wherein said shutter includes an engaging portion for being engaged with the main assembly and for moving said shutter from the closed position to the open position when said process cartridge is mounted in the main assembly.

8. A cartridge according to claim 1, wherein said spacer member is provided rotatably relative to said shutter.

9. A cartridge according to claim 1, wherein said spacer member is provided slidably on said shutter.

10. A cartridge according to claim 1, wherein said developer carrying member includes a spacing member, contactable to the electrophotographic photosensitive member at a longitudinal end of said developer carrying member, for holding a gap between a surface of said developer carrying member and a surface of the electrophotographic recording material.

11. A cartridge according to claim 1, wherein said frame is a first frame, and said cartridge further comprises a second frame for supporting said developer carrying member, and wherein at the retracted position, said spacer member enters between said first frame and said second frame.

12. An electrophotographic image forming apparatus for forming an image on a recording material, comprising:

(i) a process cartridge detachably mountable to a main assembly of an electrophotographic image forming apparatus, said process cartridge comprising:

an electrophotographic photosensitive member;

a frame for supporting said electrophotographic photosensitive member;

a developer carrying member for developing an electrostatic latent image formed on said electrophotographic photosensitive member;

an opening, provided in said frame, through which said electrophotographic photosensitive member is exposed;

a shutter, provided on said frame, movable between an open position in which said opening is uncovered and a closed position in which said opening is covered; and a spacer member movably provided on said shutter, wherein when said shutter is located at the closed position, said spacer member is movable to a spacing position in which said spacer member is between said electrophotographic photosensitive member and said developer carrying member to provide a spacing between said electrophotographic photosensitive member and said developer carrying member, and a retracted position in which said opening is covered with said spacer member;

(ii) a transfer member for transferring a developer image, obtained by developing the electrostatic latent image by said developer carrying member, onto the recording material; and (iii) a fixing device for fixing the developer image, transferred on the recording material, on the recording material.

13. An apparatus according to claim 12, wherein said process cartridge includes an urging member for urging said spacer member in a direction in which said spacer member is moved from the spacing position to the retracted position.

14. An apparatus according to claim 12, wherein when said spacer member is located at the retracted position, by mounting said process cartridge in the main assembly, said spacer member is moved from the spacing position to the retracted position.

15. An apparatus according to claim 12, wherein said shutter is shaft-supported, and wherein an area in which said spacer member located at the retracted position passes by movement of said shutter at least partly overlaps, when said process cartridge is viewed from a rotational axis direction of said shutter, with an area in which said shutter passes.

16. An apparatus according to claim 12, wherein said shutter is shaft-supported, and wherein an area in which said spacer member located at the retracted position passes by movement of said shutter at least partly falls, when said process cartridge is viewed from a rotational axis direction of said shutter, within an area ranging from a rotation axis of said shutter to an end of a passing locus of an end of said shutter.

17. An apparatus according to claim 12, wherein said shutter is moved from the open position to the closed position when said process cartridge is removed from the main assembly, and said shutter is moved from the closed position to the open position when said process cartridge is mounted in the main assembly.

18. An apparatus according to claim 12, wherein said spacer member is provided rotatably relative to said shutter.

19. An apparatus according to claim 12, wherein said spacer member is provided slidably on said shutter.

20. An apparatus according to claim 12, wherein said developer carrying member includes a spacing member, contactable to the electrophotographic photosensitive member at a longitudinal end of said developer carrying member, for holding a gap between a surface of said developer carrying member and a surface of the electrophotographic recording material.

21. A cartridge according to claim 12, wherein said frame is a first frame, and said cartridge and said process cartridge includes a second frame for supporting said developer carrying member, and wherein at the retracted position, said spacer member enters between said first frame and said second frame.

* * * * *